US005377965A

United States Patent [19]

Mandel et al.

[11] Patent Number: 5,377,965

[45] Date of Patent: Jan. 3, 1995

[54] AUTOMATIC ON-LINE SIGNATURE BOOKLETS FINISHER FOR ELECTRONIC PRINTERS

[75] Inventors: Barry P. Mandel, Fairport; Gerald A. Buddendeck, Penfield, both of N.Y.

[73] Assignee: Xerox Corporation, Stamford, Conn.

[21] Appl. No.: 148,454

[22] Filed: Nov. 8, 1993

[51] Int. Cl.[6] ..... B41L 43/12; B65H 39/02

[52] U.S. Cl. ..... 270/37; 270/54; 493/420

[58] Field of Search ..... 270/32, 37, 51, 54

[56] References Cited

U.S. PATENT DOCUMENTS

| | | | |
|---|---|---|---|
| 2,895,730 | 7/1959 | Biel et al. | 270/37 |
| 3,412,994 | 11/1968 | Dutro | 270/54 |
| 4,406,649 | 9/1983 | Yamamura . | |
| 4,518,381 | 5/1985 | Wakatsuki . | |
| 4,592,651 | 6/1986 | Oikawa et al. . | |
| 4,595,187 | 6/1986 | Bober . | |
| 4,643,705 | 2/1987 | Bober . | |
| 4,727,402 | 2/1988 | Smith . | |
| 4,814,822 | 3/1989 | Acquiviva et al. . | |
| 4,869,712 | 9/1987 | Ishino . | |
| 4,891,681 | 1/1990 | Fiske et al. . | |
| 4,925,176 | 5/1990 | Acquaviva . | |
| 4,988,029 | 1/1991 | Fiske . | |
| 5,076,556 | 12/1991 | Mandel . | |
| 5,080,340 | 1/1992 | Hacknauer et al. . | |
| 5,108,081 | 4/1992 | Russel et al. . | |
| 5,161,724 | 11/1992 | Radtke et al. . | |
| 5,241,474 | 8/1993 | Marovac . | |
| 5,260,758 | 11/1993 | Stemmle . | |

OTHER PUBLICATIONS

Xerox Disclosure Journal -vol. 18, No. 1 Jan./Feb. 1993, p. 113 Jack R. Oagley, Author.

Research Disclosure -Dec. 1992, p. 959 #34482 Sheet Folding Device.

*Primary Examiner*—Edward K. Look

*Assistant Examiner*—John Ryznic

[57] ABSTRACT

A signatures finishing system for on-line center folding of sets of signature sheets outputted by a reproduction system; by sequentially individually fully folding the signature sheets in a folding rollers nip as they are outputted and reversing the nip at a position in which the opposite ends of the sheet engage the opposite sides of a closely adjacent saddle compiler to sequentially stack the folded signature sheets on the saddle compiler to form plural sheet compiled pre-folded signature sheet booklets, and then, after stapling, ejecting the compiled folded signatures booklet from the saddle compiler through the same folding rollers nip to a booklet output system which may perform edge trimming and stacking of the booklets ejected through the folding rollers nip.

12 Claims, 16 Drawing Sheets

AUTOMATIC ON-LINE SIGNATURE BOOKLETS FINISHER FOR ELECTRONIC PRINTERS

Disclosed is a simpler and lower cost and improved system for "on-line finishing" of folded booklets. In particular, there is disclosed a simplified signatures finishing system providing center-folded and fastened booklets of signature collated pages outputted by an electronic printer, or other reproduction apparatus.

The disclosed system provides improved sheet folding or creasing of each signature sheet in a finished booklet, for flatter, better stacking, and more professionally appearing finished booklets.

The present system can provide lower cost "on-line finishing" of properly folded booklets, with reduced component parts and/or overall size of the apparatus. In particular, there is disclosed in the embodiment herein a mutimode, shared functions, folding and feeding rollers system, and also its integration with a simple "roof" or "saddle" type folded set compiler/stapler. With this disclosed system, the same roller set can be utilized for positively individually center creasing each signature sheet sequentially, and also for ejecting or feeding out each bound set of multiple signatures. The disclosed system can sharply crease and fold large signature sheets presented short edge first, desirably allowing a narrower processor without requiring sheet rotation or an "L" shaped path. The disclosed module accepts such printed output directly and linearly.

Further by way of background, especially as copiers and printers increase in speed and capabilities, it it is desirable for their paper handling and output to be more automated and made more reliable in general. "On-line finishing" is one means for such improvements. It may be roughly defined as a system in which the document pages being copied are printed in a order such that each copy set or job set comes out precollated, and thus can be automatically finished [stapled, glued or otherwise bound] in collated sets without manual handling or post-collation, starting immediately with the first set, and while subsequent copy sets of that same job are being printed by that reproduction apparatus. Preferably the finisher is integral, or a separable module at the output of, the reproduction apparatus for directly sequentially receiving the individual sheets as soon as they are printed.

The present system is particularly desirable for known and future "desktop publishing" systems, because it can provide "on-line" immediate booklet printing and binding therefor. Desktop or system connected on-line publishing systems are especially suitable for rapid turn-around small to medium run magazines, internal or annual reports, sales brochures, reprints, service manuals, or any other specialized or limited publication customer needs. In "desktop publishing" systems or other integrated printing systems, a complete job such as a booklet and all its desired properties, text, graphics, desired paper stock, covers, number of copies, color of toner or ink, etc., may all be composed and/or specified at any remote terminal or workstation (with or without an accompanying "job ticket" or the like), and sent electronically to a remote and/or centralized electronic printer for printing and finishing. The printed and finished job sets may be further automatically processed by addressing and/or mailing or mailboxing distribution systems.

Background information on "mailbox" output systems is available in copending, commonly assigned, U.S. applications Ser. No. 08/05492 by the same Barry P. Mandel and Richard A. Van Dongen, entitled "Mailbox/Compiler Architecture", and Ser. No. 08/05493, by Barry P. Mandel and David R. Kamprath, entitled "Shared User Printer Output Dynamic 'Mailbox' System", both filed Apr. 27, 1993.

"Signature" printing is an old and well known term of art in book printing. Conventionally, a signature is a sheet printed and intended to be center folded and center fastened in pamphlet or book binders. A collated set of plural stacked signature sheets which are center folded and center fastened may provide an individual booklet, with pages which can be turned in a normal manner. That can also be called a single "quire", although the term "quire" is more commonly used where each "quire" is differently paginated and intended to be fastened together in traditional bookbinding with the other quires to form a traditional book. The term "booklet" is used broadly and generally herein. Signature sheets are normally duplex (both sides) printed with 4 pages total in signature pairs page order. Often they are 11"×17" (or European or Japanese equivalent) large copy sheets which, when center folded, form booklets of standard letter or office size. The requisite center spline stapling, stitching or gluing of collated sets of such signatures is preferably done in automatic signature [book] binders. Another term used for signature finishers is a "Signature booklet maker" or SBM. These may, or may not, collate the sets of signatures on what is called a "saddle stitcher" or "roof stitcher".

Signature binders are optional accessories for several Xerox copier/duplicator and printer products. It is also reported that signature booklets have been commercially printed on the duplex version of the Xerox "9700" laser printer with signature printing software for many years. These commercial signature finisher units, from C. P. Bourg, Plockmatic International AB, and others, are set staplers/folders/trimmers which do adjustable book edge trimming as well as center stapling or stitching, center folding, and output stacking, and may or may not do the collated set compiling. That is, they provide, in an accessory module, a stitcher, folder and trimmer for on-line signature booklet making from signature printing output, with or without copy output sheet rotators, cover or other sheet inserters, etc.. Interface sheet transports for mating the printer output level to the signature module input level may also be provided.

While signature printing and binding of booklets has been done for years to a limited extent on copiers, it is especially suitable for automatic duplex electronic printers, since the pages can be easily automatically electronically reordered and easily printed in signature rather than normal order for signature printing. Modular signature finishers, as noted above, have been provided for and used with the Xerox Corporation "DocuTech" electronic printer and other electronic printer products for on-line booklet finishing. Some recent Xerox patents show in a common schematic figure, and provide some description of, the C. P. Bourg accessory signature finisher for the Xerox "DocuTech" printer, e.g., U.S. Pat. Nos. 5,159,395 and 5,184,185, Cols. 13–16 and FIG. 9, issued Feb. 2, 1993. Pending allowable Xerox "DocuTech" printer patent applications U.S. Pat. No. 5,271,065 and U.S. application Ser. No. 08/093,845 allowed also disclose automatic margin or gutter adjustments between the respective signature sheets for folded signature set edge trimming differences. [The below-cited U.S. Pat. No. 4,891,681 is also relevant to that.] However, many of these compile the copy sets flat, and fold the set only after the entire set is compiled, which does not sharply crease the outside pages, leading to a much thicker portion of the finished book near the spline or center binding area, which tends to spring open.

Xerox Corporation patents on the general subject of generating collated signatures at a copier output include, e.g., U.S. Pat. No. 4,727,402 issued to R. E. Smith Feb. 23, 1988; U.S. Pat. No. 4,925,176 issued May 15, 1990 to T. Acquaviva (see Cols. 3–4); U.S. Pat. Nos. 4,814,822; and 5,241,474; and other art cited therein. Said Smith U.S. Pat. No. 4,727,402 also generally suggests in FIG. 2, at 113, output to a "saddle" or "roof" type collator/stitcher [an angled signatures center or spline stapler]. Also noted on signatures set staplers or stitchers are Kodak U.S. Pat. Nos. 5,108,081; 5,080,340; 4,988,029; 4,891,681; and 5,161,724; and Ricoh 1984 U.S. Pat. No. 4,592,651.

Noted as of particular interest with reference to creasing one signature sheet at a time and "inverted V" (saddle or roof) compilor stacking of plural said signature sheets for on-line booklet (signature) finishing is Xerox Corp. U.S. Pat. No. 4,595,187, issued Jun. 17, 1986 to Henry T. Bober. However, this Bober U.S. Pat. No. 4,595,187 disclosed system only "scores" and slightly (partially) prebends the sheets, rather than fully folding and tightly creasing each sheet so that it will lie flat in a finished booklet. Also, the booklets in Bober are not fully closed before ejection/stacking. Also, this Bober system creases sheets in the process direction and is for long-edge fed sheets, whereas short-edge feed is more common and desirable for signatures.

For the typical large, e.g., 11 by 17, sheets printed as signatures, it is known that a sheet rotator may be provided upstream of the signature finisher, e.g., Xerox Corporation U.S. Pat. No. 5,090,638, issued Feb. 25, 1992 to this same B. P. Mandel, et al., and art cited therein. However, as noted above, this is desirably avoided, and adds space, complexity, cost, and an additional sheet jam site.

The extensive art on sheet folding in general includes, for example, on-line folders for copiers, such as U.S. Pat. No. 5,076,556 by Barry P. Mandel on "Z-folders"; a Xerox Disclosure Journal publication of January/-February 1993, Vol. 18, No. 1 p. 113–122 by Jack R. Oagley; a "Research Disclosure" Publication No. 34482, December 1992, pp. 959–961, "Sheet Folding Device"; and Fuji Xerox U.S. Pat. Nos. 4,518,381; 4,406,649 and 4,869,712.

Some examples of prior patents disclosing high-capacity output sheet set stackers include Xerox Corporation U.S. Pat. No. 5,098,074, issued Mar. 24, 1992 to Barry P. Mandel, et al., and Eastman Kodak Company U.S. Pat. No. 5,026,034, issued Jun. 25, 1992 to Steven M. Russel, et al., and art cited therein. An integral or modularly related copy set compiler and stapler or other finisher is disclosed in said U.S. Pat. No. 5,098,074 and art therein and Canon U.S. Pat. No. 5,137,265.

The present system may, of course, be optionally combined or provided with an orbiting nip or other optional sheet output inverter and/or plural mode or other alternative outputs for unbound sheets, etc., as disclosed for example in commonly assigned U.S. Pat. No. 5,201,517 issued Apr. 13, 1993 to Denis Stemmle entitled "Orbiting Nip Compiler for Faceup or Facedown Stacking".

It is also additionally noted that combined facsimile and/or digital scanning, copying and printing (and even optional conventional light lens or digital direct copying) can be provided in a known manner in an integral or multifunctional or "combo" unit which may also be encompassed by the term "printer" as used herein.

The signature printing, finishing, and or other instructions and controls can be provided locally on the printer and/or the subject signature finishing module, or remotely. Examples of printer "job ticket" (job control sheet) patents include U.S. Pat. Nos. 4,970,554, 4,757,348, and 4,987,447. Examples of Xerox Corporation U.S. patents on systems with a network, server and printer (usually for shared user's remote terminals) include: U.S. Pat. Nos. 5,170,340; 5,153,577; 5,113,517; 5,072,412; 5,065,347; 5,008,853; 4,947,345; 4,939,507; 4,937,036; 4,899,136; 3,958,088; 3,920,895; 3,597,071; 5,133,048, and the October 1990 publication "The Xerox DocuTech® Production Publisher" from BIS CAP International, Newtonville, Mass., by Charles LeComte. Also, Fuji Xerox Co. U.S. Pat. No. 5,113,355 and IBM Corp. U.S. Pat. Nos. 4,651,278 and 4,623,244. Other network systems publications are "Mastering Novell® Netware®", 1990, SYBEX, Inc., Alameda, Calif., by Cheryl E. Currid and Craig A. Gillett; "Print (Almost) Anything Anywhere", "DATAMATION", Newton Mass., Sep. 15, 1992; "Interpress TM: The Source Book", Simon & Schuster, Inc., New York, New York, 1988, by Harrington, S. J. and Buckley, R. R.; and Adobe Systems Incorporated "PostScript® Language Reference Manual", Addison-Wesley Co., 1990. Such document systems can support the capabilities of remote workstations, PC terminals, and facsimile devices, and connect them for shared use of an electronic printer, usually via a print server and/or shared user interface formatting print service. The software system can also control local print job queue management, communications re job status, print options, etc..

The disclosed apparatus may be readily operated and controlled in a conventional manner with conventional control systems, such as the above and other existing ones in printers, copiers, and their controllers, e.g., U.S. Pat. No. 4,475,156 and art cited therein. It is well known in general and preferable to program and execute such control functions and logic with conventionally written software instructions for conventional microprocessors. This is taught by various patents and commercial printers. Such software may of course vary depending on the particular function and the particular software system and the particular microprocessor or microcomputer being utilized, but will be available to or readily programmable by those skilled in the applicable arts without undue experimentation from either verbal functional descriptions, and/or drawings, such as those provided herein, together with general knowledge in the software and computer arts. Controls may alternatively be provided utilizing various other known or suitable hard-wired logic or switching systems.

As to other specific hardware components of the subject apparatus, or alternatives therefor, it will be appreciated that, as is normally the case, some such specific hardware components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the example below, as well as the claims. Thus, the present invention will be better understood from this description of this embodiment thereof, including the drawing figures wherein:

Figure 1:
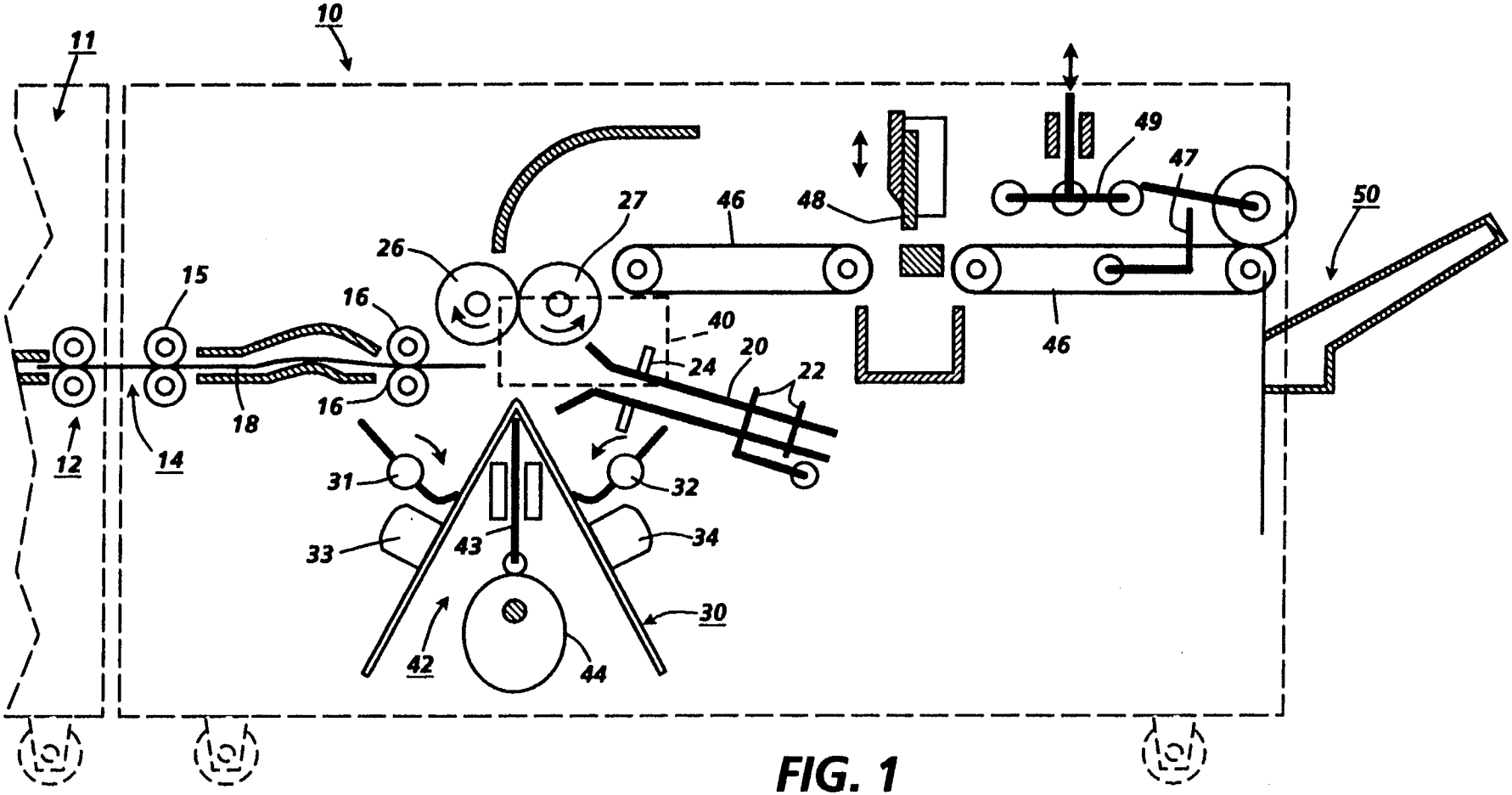
FIG. 1 is a schematic frontal view of one exemplary signatures finisher module in accordance with this invention, with a sequential sheet full folder, sheets compiler, stapler and job set ejector, in one integral unit, also showing schematically one example of the output end of an operatively connecting electronic printer.
Figure 2:
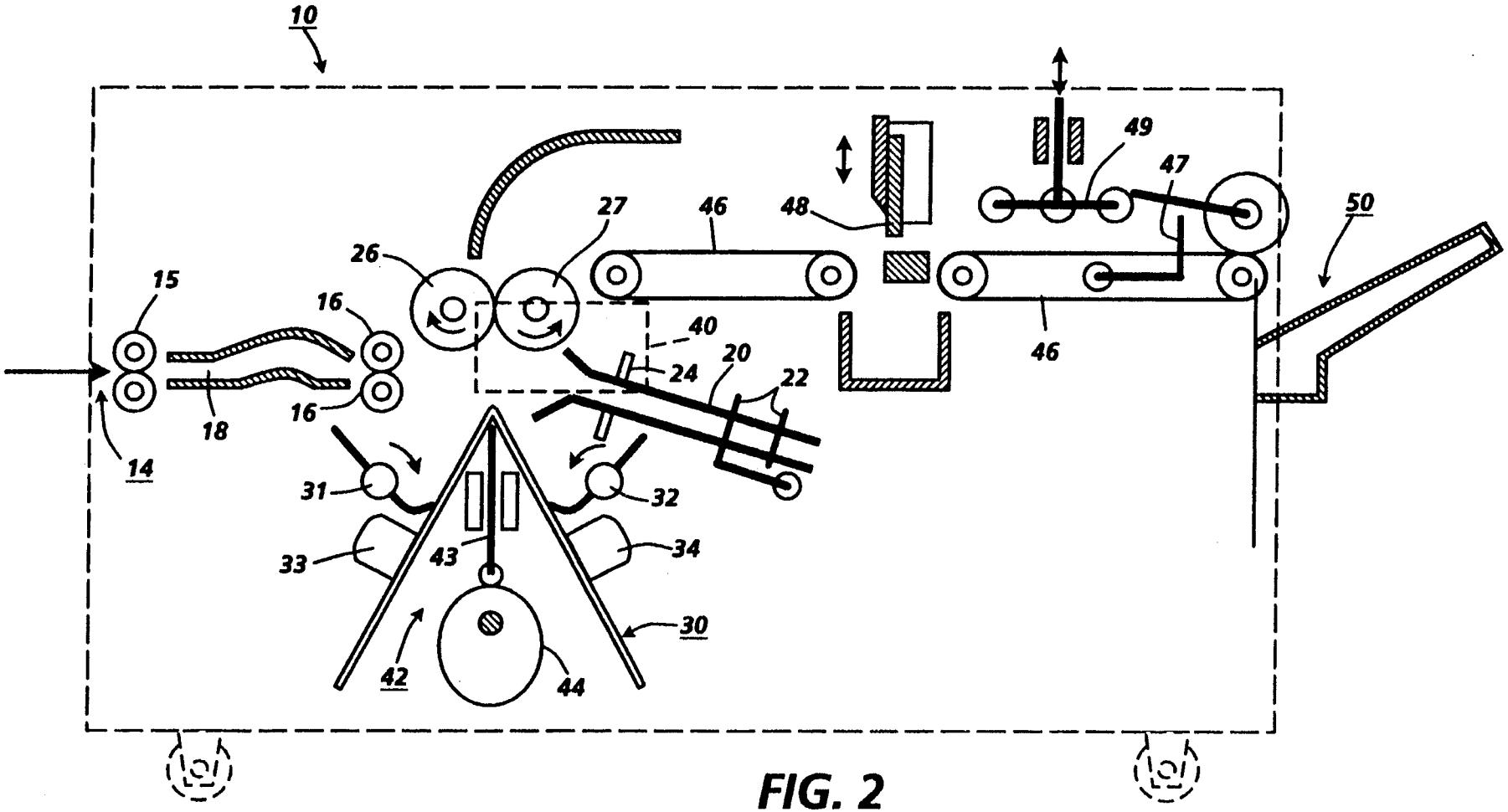
FIG. 2 is a more detailed internal schematic frontal view of the exemplary signature finishing system of FIG. 1.
Figure 3:
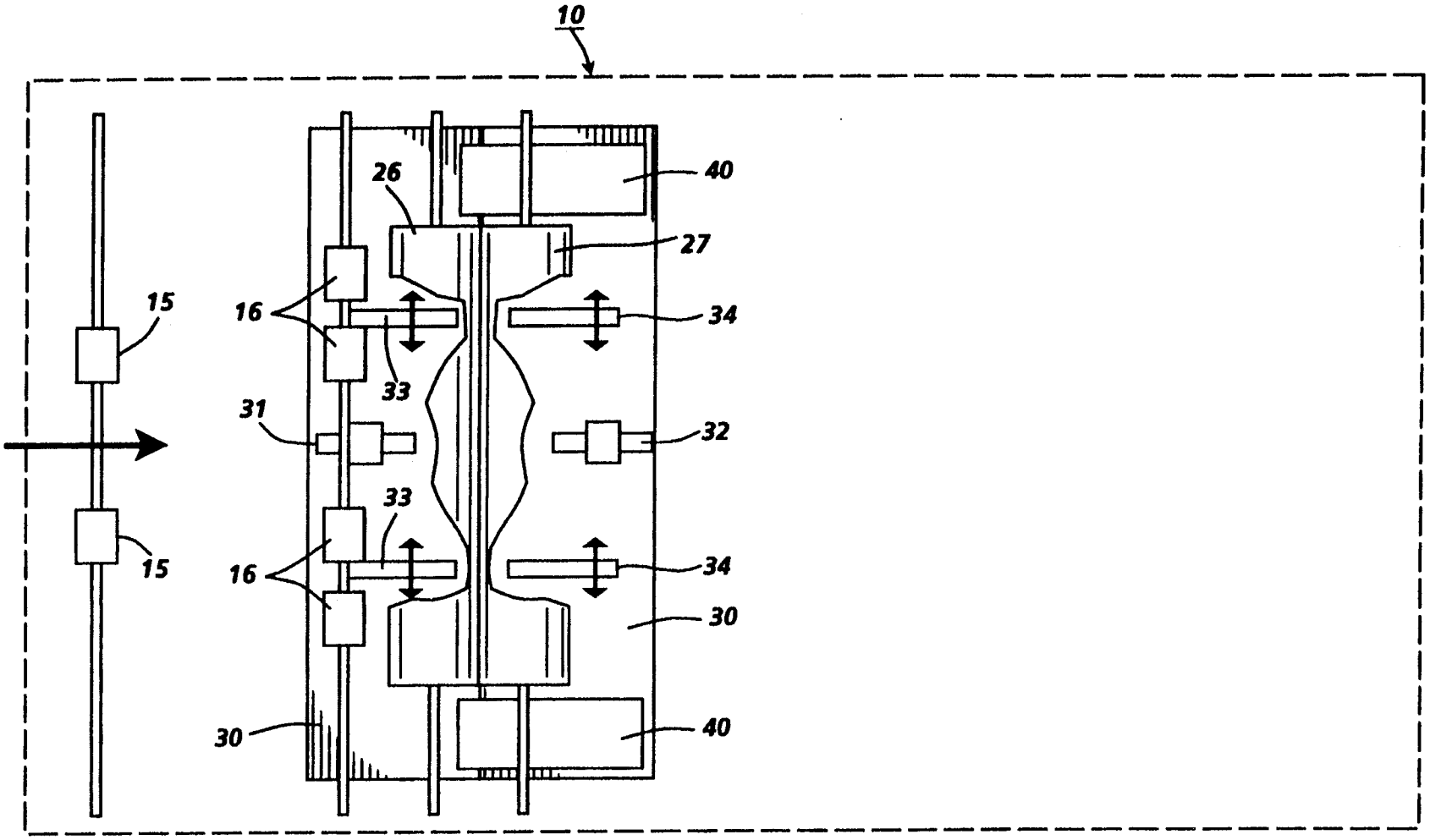
FIG. 3 is a partial schematic top view of the system of FIGS. 1 and 2.

Referring first to FIGS. 1–3, the signature finisher 10 example here is shown directly adjacent an electronic printer 11 capable of producing and/or outputting printed signature sheets short-edge first. The printer 11 is only shown schematically, since it may be conventional, and thus need not be further described herein. The cited and other art provides examples and alternatives.

There is disclosed in this example 10 a compact, low cost, saddle stitching booklet maker capable of producing tightly folded booklets that lie flat. The system 10 uses a unique fold roll system and compile tray geometry and paper path that enables the individual signature sheets to be individually buckled and fully folded with a sharp crease sequentially as they are outputted by the printer, before compiling, and then readily compiled folded into a set, quire, or other such booklet on a "roof" or "saddle" compiler cooperatively adjacent the fold roll system. This enables each sheet in each booklet to have a tight crease and full fold, for flat-lying professional looking booklets. The illustrated finishing device 10 also includes a set of dual function tampers that compiles the individual sheets on a "roof" or "saddle" compiler, and also move the compiled set into position for stapling. Set ejection from the compiler is provided in this example by an ejecting knife edge or fingers, but into and through the same fold roll system which previously folded the individual sheets thereof, saving space and apparatus.

By way of background, booklets which are made by compiling first, before the sheets are folded together, i.e., folded as a set (whether stapled before or after folding), have a problem. Although the innermost sheets of the set are folded reasonably tightly, the folds in the outer sheets of the set are formed around those inner sheets, and thus around a radius. For this reason, the outer sheets are not folded with a tight crease, and have a tendency to spring back open and/or for the folded end of the booklet to "bulge". Thus, it is preferable to sharply and fully fold each sheet individually before compiling them into sets. However, heretofore this has required relatively large and complex finishing equipment, or delays and/or manual handling of the sheets. Here, the sheets are immediately sequentially folded and compiled automatically, on-line.

As will be further described in the examples herein, fold rolls such as 26, 27 are provided which sequentially fully fold each incoming sheet. Those fold rolls are desirably positioned directly over an "inverted V" or saddle-shaped compiler 30 so that the reversal of the feed rolls (and gravity) can sequentially place each folded sheet directly onto the compiler. After a set has been so compiled, stapling may then be provided while the set is on the same compiler. Here a pair of staplers 40 is schematically illustrated respectively mounted inboard and outboard of the fold rolls, so as not to interfere therewith. Tampers 33, 34 associated with the compiler may be used to slide the compiled set laterally (along the compiler axis) to these inboard and outboard staplers 40 for stapling (or to sequentially step through appropriate stapling positions past a single stapler, if that is desired). The stapled set ejection system 42 may desirably include a lift mechanism located directly under the compiler to eject the stapled booklet up in to the same fold rolls 26, 27. The fold rolls feed the set on to an exit transport, for entrance into a trimming station for edge trimming, and then ejection of the completed set into a set stacker.

Figure 14:
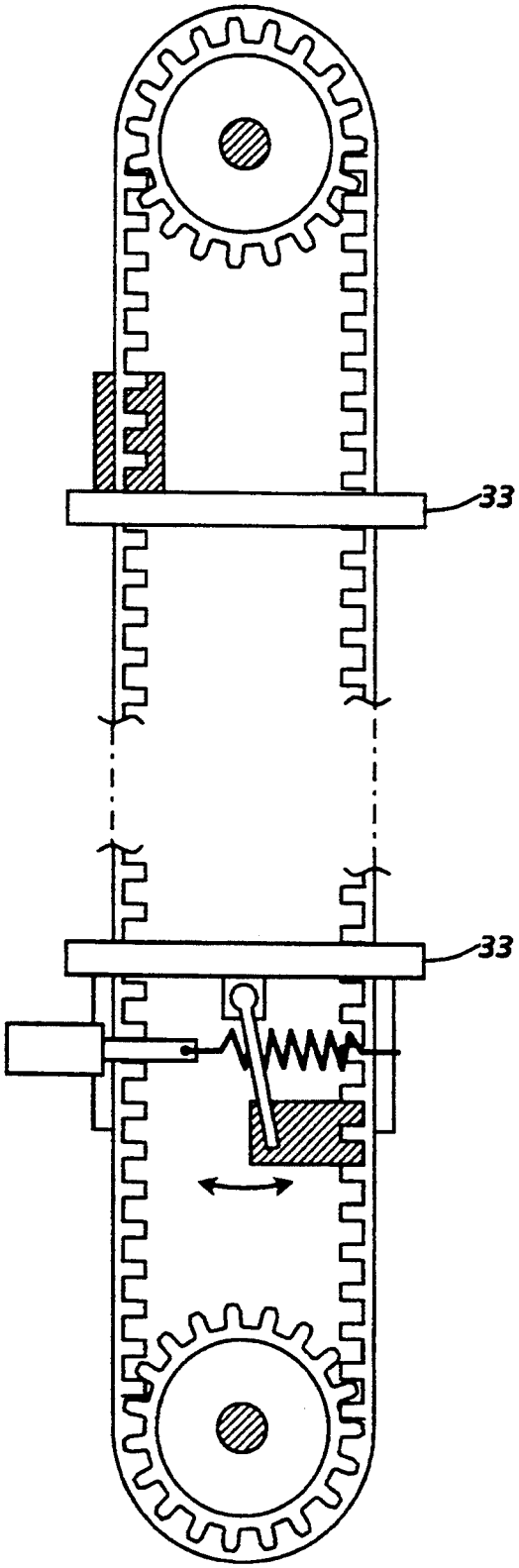
FIG. 14 shows one example of a dual mode set tamper drive for both compiling sets and shifting sets for stapling.

FIG. 14 shows an example of a dual mode set tamper drive which can provide both compiling of the sets in evenly aligned stacks in the compiler and also the above-noted shifting of the sets for stapling. This is done here with only two pairs of tampers on each side of the compiler. One of the tampers of each pair is provided with dual motions, that is, a motion towards the other tamper for tamping the stack edges during compiling, and then a different, synchronous, motion together to slide the entire set back and forth for stapling (and/or for set ejection). Although independent drives could be used for the front and rear tampers, the system disclosed in FIG. 14 enables this dual mode operation with only one drive motor, one drive belt, and a simple clutch changing the engagement of one of the tampers from one side of the drive belt to the other, so as to reverse the motion of that tamper, since the opposite sides or flights of the belt are moving in opposite directions.

Figure 15:
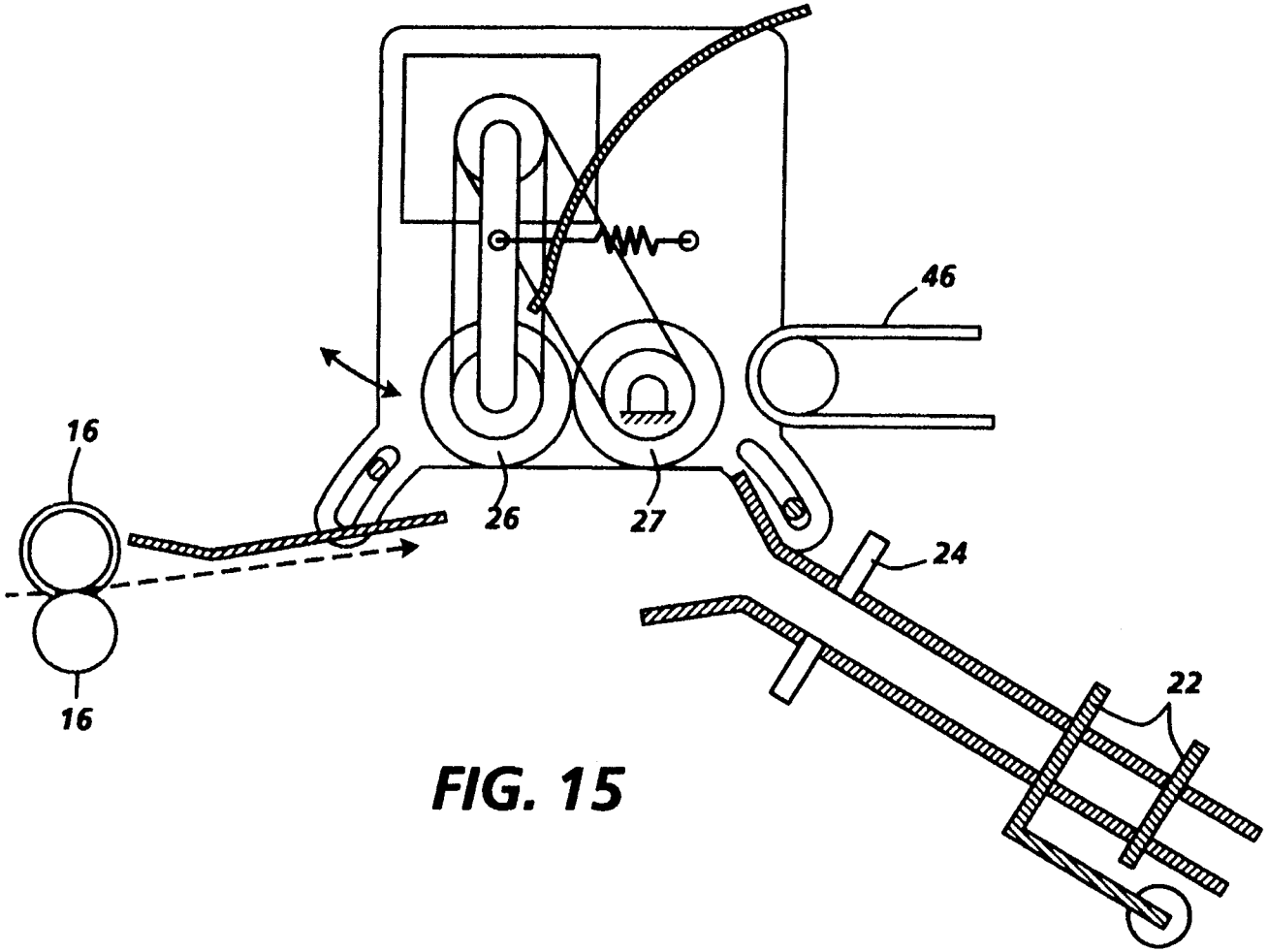
FIG. 15 is an enlarged and more detailed view of one example of the exemplary sheet fold roll variable nip.

As further illustrated in FIG. 15, the fold rolls 26, 27 are spring loaded together to provide a variable nip. One of the rolls may be on a fixed axis and conventionally driven, although a stepper motor or servo motor system drive may be desirable to enable more accurate velocity and positioning control, as well as the drive reversal described below. The other or idler roller defining the fold nip may be pivotally spring mounted so as to enable that idler roll to move relative to the driven roll, so that the roll nip may be spread apart slightly during the folding of a sheet, and then spread apart substantially further for the ejection of the folded set of multiple sheets through the same nip.

It will be appreciated that the roof compiler stapler, set ejector, set exit transport and set edge trimming station examples here can be similar to various of those in existing booklet makers, and thus further details of these subsystems need not be disclosed herein.

Turning now to the operation of the first exemplary device herein, this is sequentially illustrated in FIGS. 4 through 13. Note that in these figures the staplers are not shown, for clarity.

Figure 4:
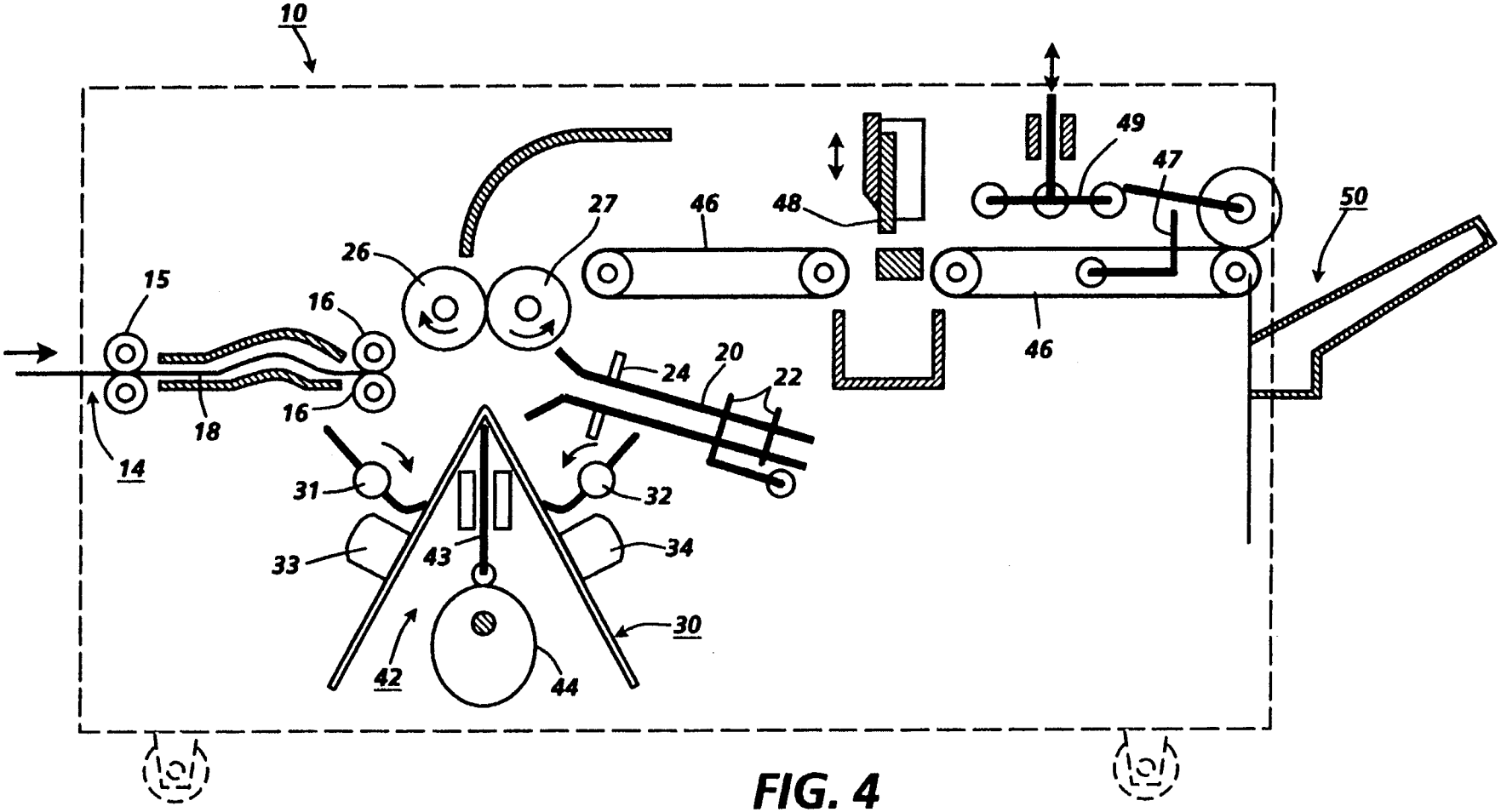
FIGS. 4 to 13 are all identical to FIG. 2, and illustrate successively the operation of the system of FIGS. 1–3.

In FIG. 4, the first signature sheet 18 is shown entering from the printer 11 (not shown in these views) from its output 12. The sheet enters the directly adjacent communicating sheet input 14 of the automatic book binding module 10. This sheet input 14 here includes upstream rollers 15 and downstream rollers 16 and an intervening buckle chamber. The rollers 16 are temporarily stalled here in a conventional manner to slightly buckle the sheet for purposes of deskewing the incoming sheet immediately before the entrance to the folder system. However, it will be appreciated that if the sheets are entering the module 10 already sufficiently deskewed or unskewed, that this input system may not be required.

Figure 5:
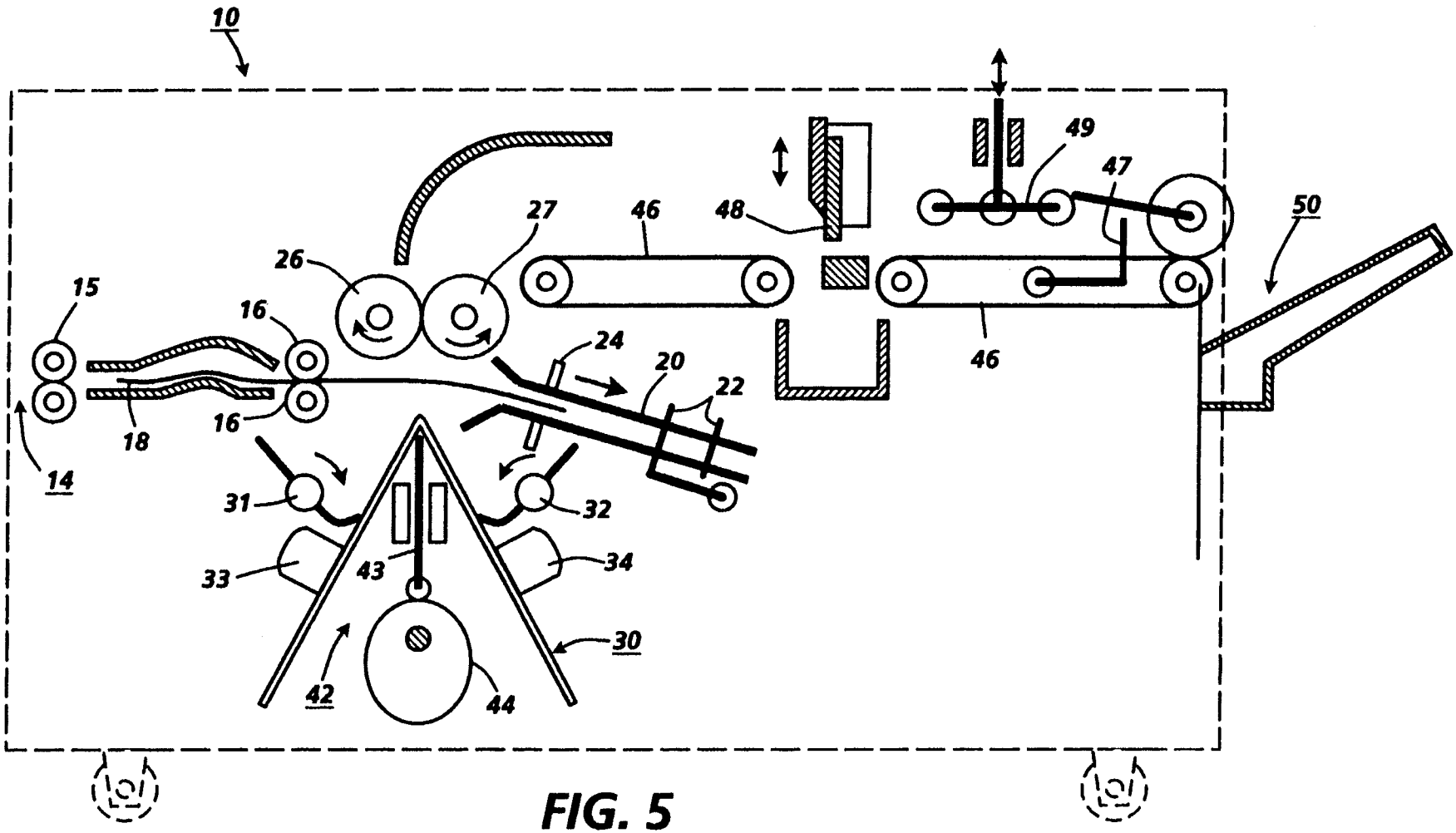

Referring now to the next step shown in FIG. 5, the sheet 18 is now fed out by the deskewing rollers 16 into a fold plate or chute 20 until the lead edge of the sheet 18 reaches a fold plate gate 22 at the desired stopping position of the sheet, which is with the leading area or approximate front half of the sheet 18 in the fold plate 20. The position of the fold plate gate 22 will of course vary or be reset depending upon the size of the signature sheet to be folded and its desired fold line location. (Central sheet folding is shown here.)

Note that as the sheet 18 enters the folder area it passes directly under the nipped pair of fold rolls 26, 27, which, during this sheet entrance movement, are turning in the direction illustrated by the movement arrows thereon, so as to prevent the lead edge of the sheet from stubbing and catching on the right hand fold roll 27. Also note that the sheet 18 is fed in directly over and above the "saddle" or "roof" compiler 30, which is in the shape of an "inverted V" pointing directly towards the nip of the fold rolls 26, 27 with the peak or ridge of the "V" relatively closely adjacent to this nip.

Figure 6:
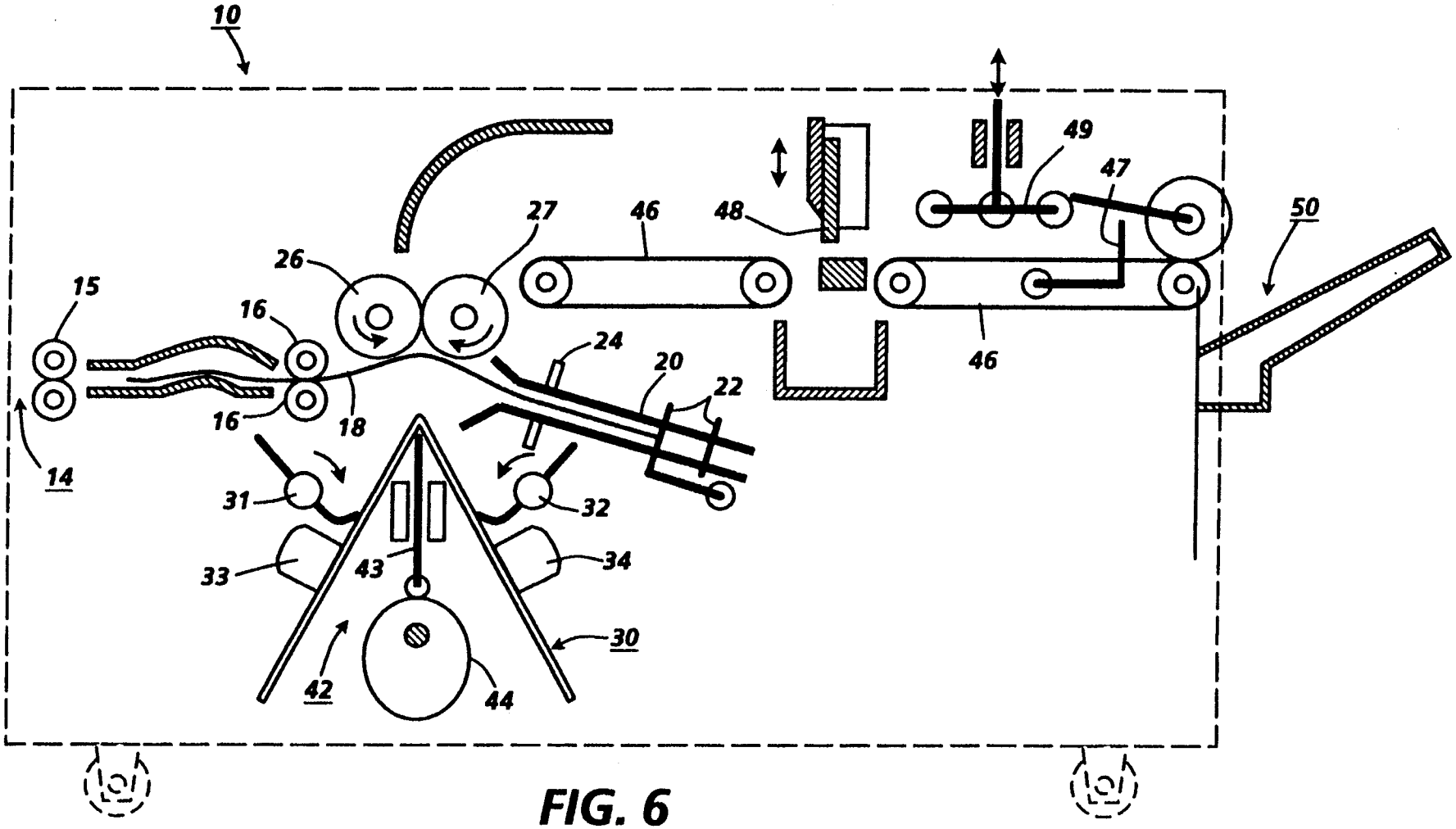

Referring now to FIG. 6, once the lead edge of the entering sheet has passed a fold plate sensor 24, the fold rolls 26, 27 reverse direction, as shown in this Figure. As soon as the lead edge of the sheet 18 hits the fold plate gate 22, the central portion of the sheet 18 begins to buckle upwards toward the nip of the feed rolls 26, 27, as shown. This is assisted by the slightly downwardly inclined angle of the fold plate 20 relative to the sheet entrance nip feed rollers 16, which rollers 16 continue to push in the trailing portion of the sheet, to continue to increase the buckling of the sheet, as shown in FIG. 7.

Figure 7:
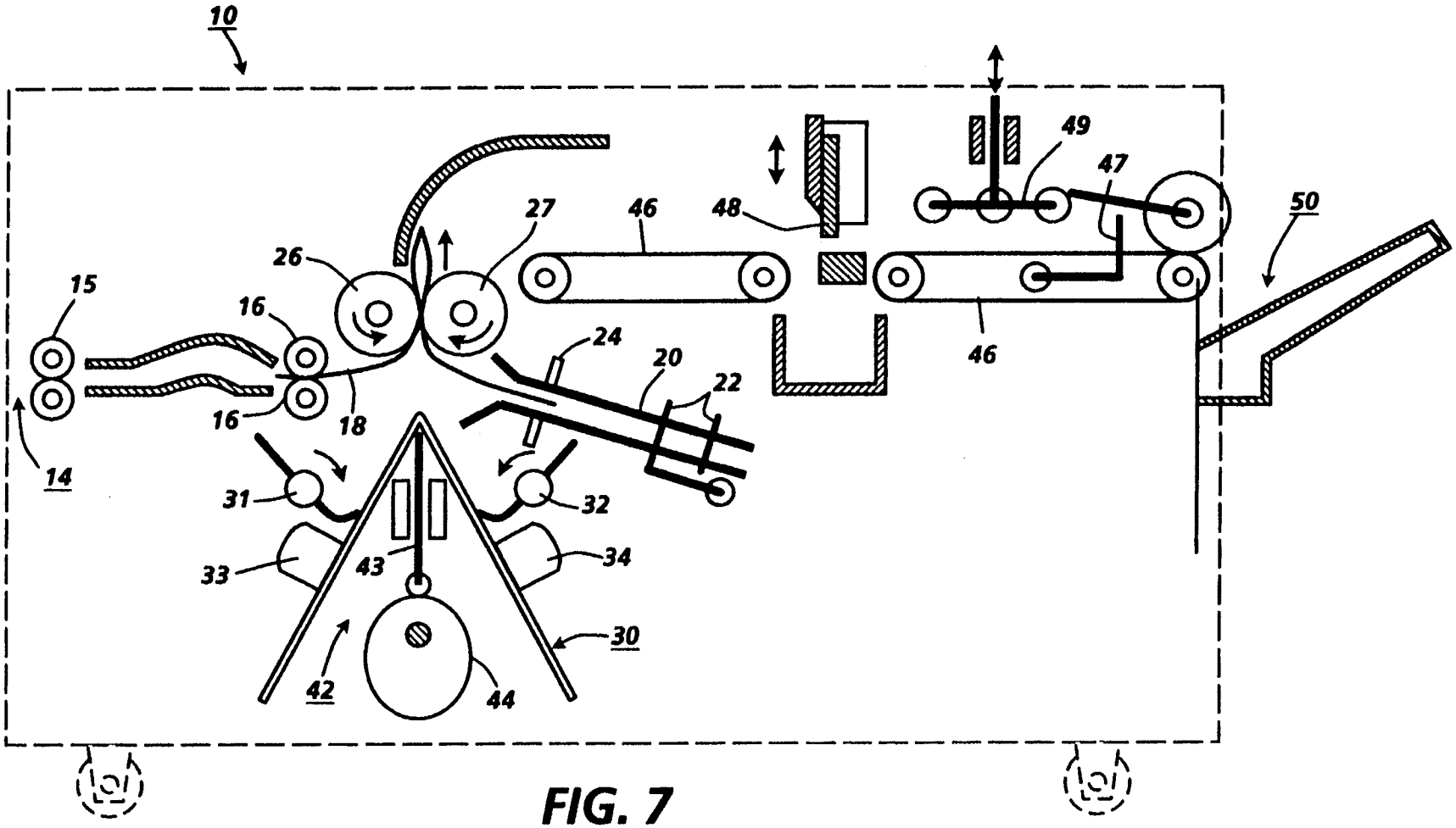

Thus, as shown in FIG. 7, the center of the sheet is buckled up into the nip of the fold rolls 26, 27 and drawn into these fold rolls and fed therethrough to be firmly creased and fully folded together by a substantial nip spring pressure provided between the fold rolls 26 and 27. However, the entire sheet 18 is not drawn all of the way through the fold rolls 26, 27. After the former lead edge (now one of the trailing edges) of the sheet 18 unblocks the fold plate sensor 24, and after that end of the sheet has been pulled out of the fold plate 20 by the fold rolls, the fold rolls 26, 27 are stopped, as shown in FIG. 8.

Figure 8:
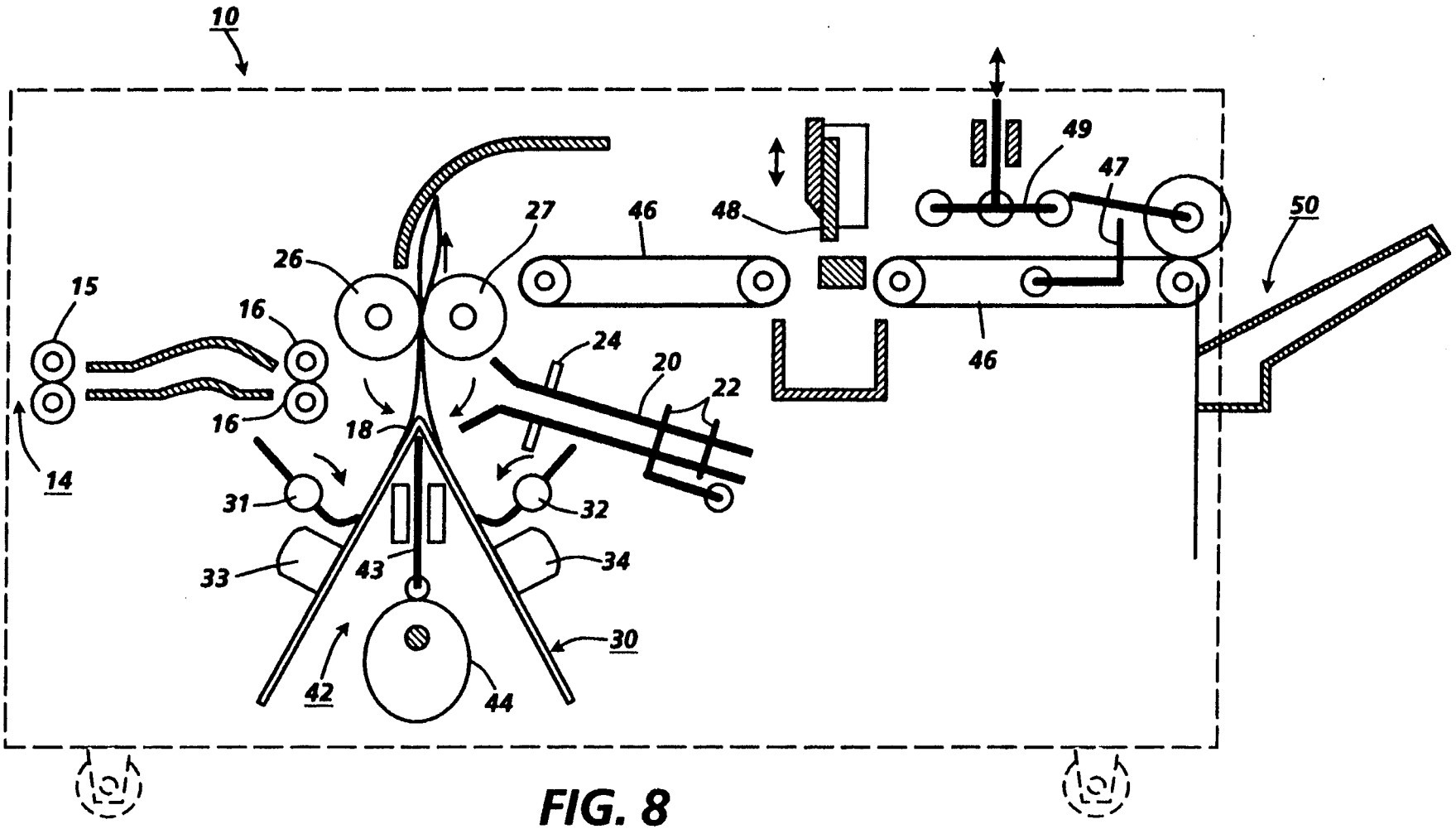

As shown in FIG. 8, the fold rolls 26, 27 stop with the now-folded sheet in a position such that the two trail edges of that sheet are released from the fold plate 20 and also from the entrance nip roller 16. Thus, these sheet ends follow their natural tendency (from both beam strength and gravity) to move towards each other, as shown. However, the distance between the nip of the fold rolls and the upper edge of the compiler 30 is less than the distance between the nip of the fold rolls and the edge of the fold plate. Thus, the two ends of folded sheet 18 cannot fully close, and are prevented from doing so by the two sides of the compiler 30, which the sheet ends respectively now engage.

Figure 9:
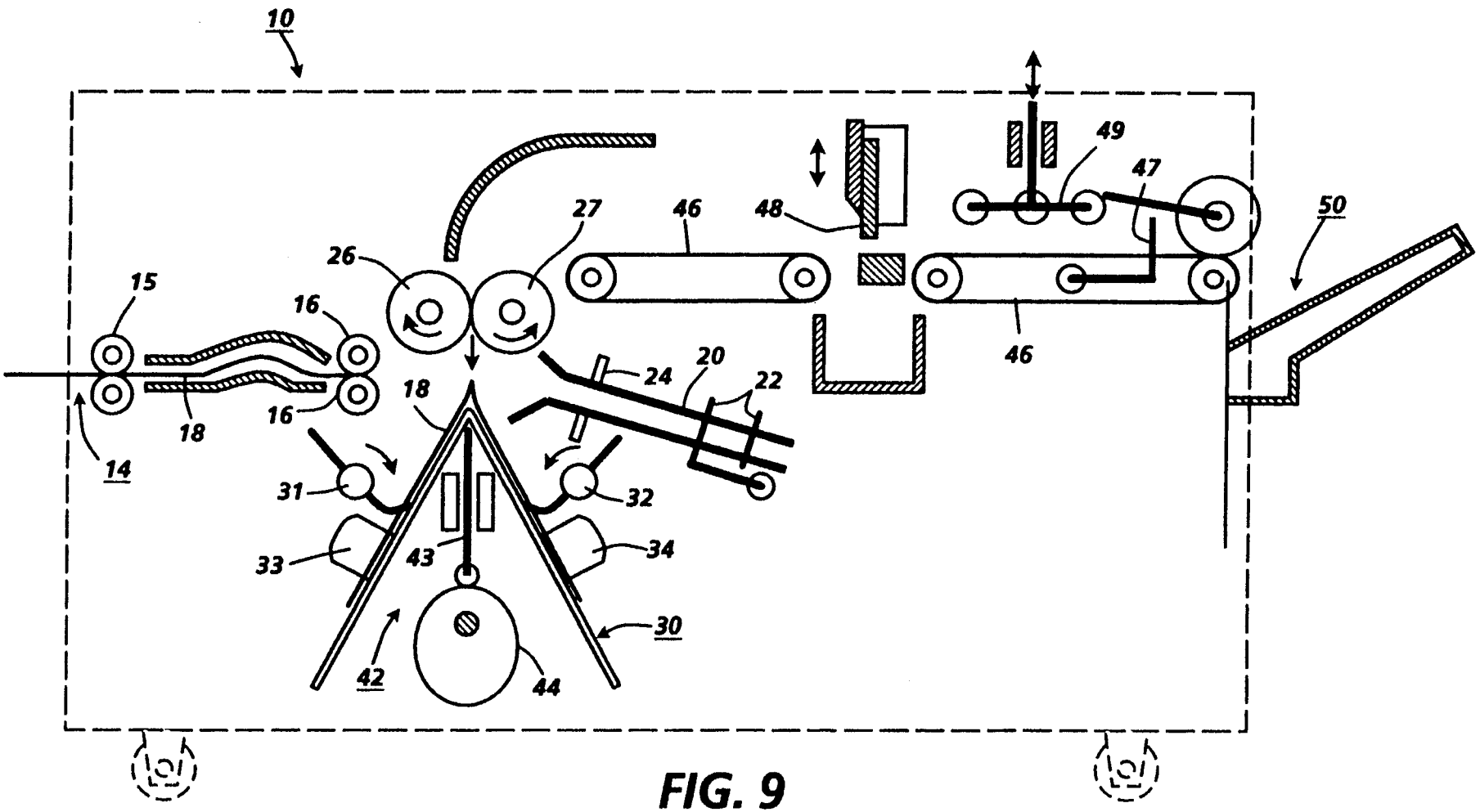
Figure 10:
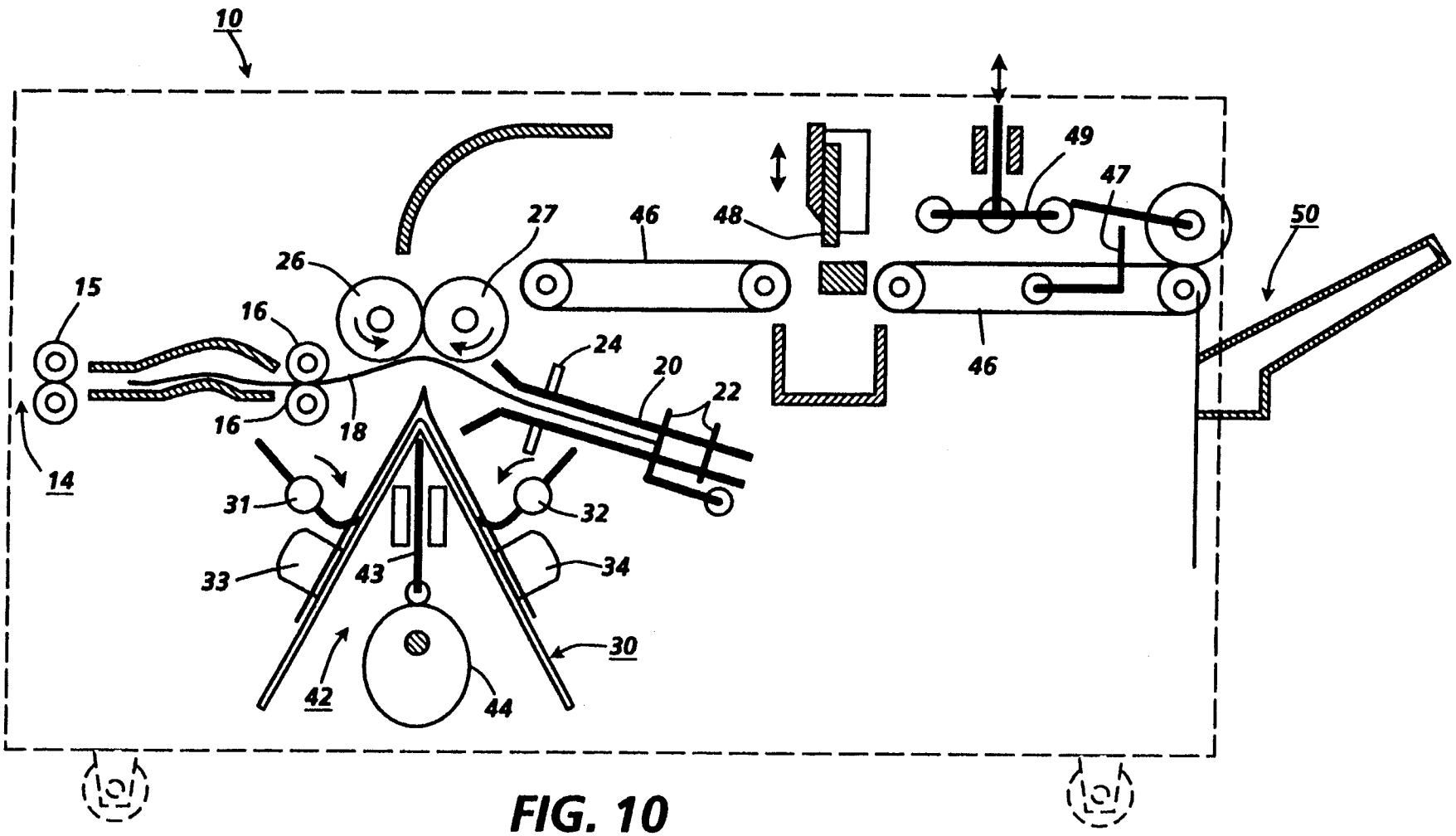

As shown in FIG. 9, the fold rolls 26, 27 are now reversed, and the folded sheet 18, also with the assistance of gravity, is driven down onto the saddle compiler 30. For the final downward movement of the folded sheet 18 onto the compiler 30, after the spline of the folded sheet is released from the nip of the fold rolls, paddle wheels 31, 32 may be provided to respectively engage the two sides of the sheet now riding down on the two sides of the "inverted V" compiler 30 (or onto the previous sheets so stacked thereon, if any). Because the paddle wheels 31, 32 have long flexible blades, they can accommodate the increasing height of the sheets stacked on the compiler and remain in contact with only the outermost or top sheet. [Meanwhile, as shown in FIG. 10, the next incoming sheet is being folded, as described above.]

Pairs of tampers 33, 34 are provided inboard and outboard of the sheets stacked on the compiler 30 for moving the sheets by their lateral edges into a desired registration position. As each further sheet is inputted, folded and placed on the compiler 30 in the same manner as described above, these pairs of tampers 33, 34 move toward each other to align the sheets in a fully aligned stack.

Figure 11:
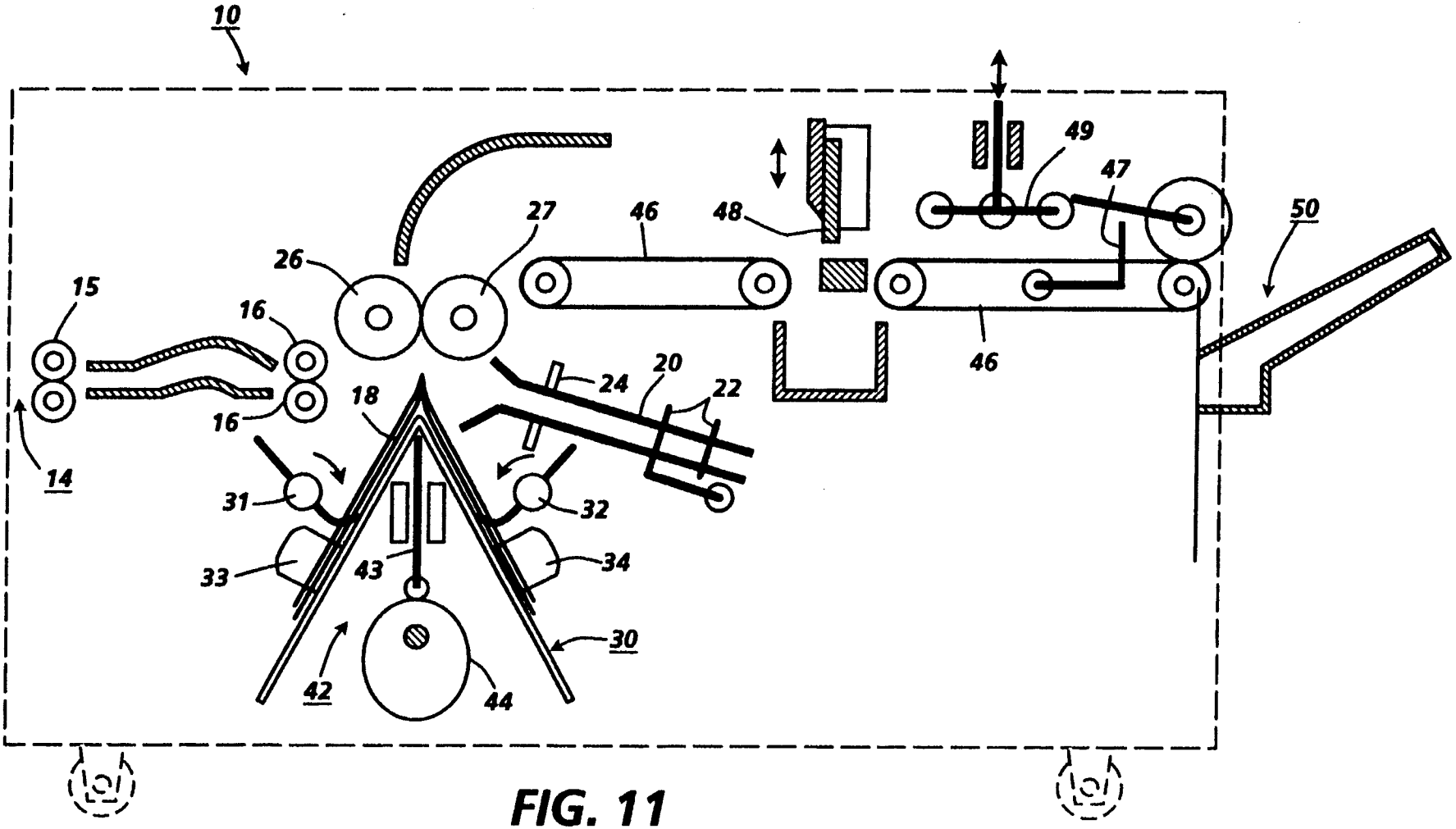

Referring to FIG. 11, after the complete set of collated sheets has been compiled into a booklet of all the printed pages for that booklet, the operation of the tampers 33, 34 may be changed, as described elsewhere herein, and illustrated for example in FIG. 14, to drive the set laterally under the staplers. It will be appreciated that this is not required, but is desirable here for the provision in this example of staplers which are in the front and rear (inboard and outboard) of the fold rollers 26, 27. Thus, the set may be moved outboard frontwardly toward the front stapler, and then rearwardly under the rear stapler, to "saddle stitch" the set in at least two spaced positions along its folded center or spline, conventionally. Alternatively, a single stapler could be used, and the set could be shifted by a greater distance along a longer axis compiler 30, to enable the same stapler to staple the set in at least two locations. Alternatively, one or more staplers could be moved or swung into the folder space to staple the set without moving the set out of its initial compiler position.

Figure 12:
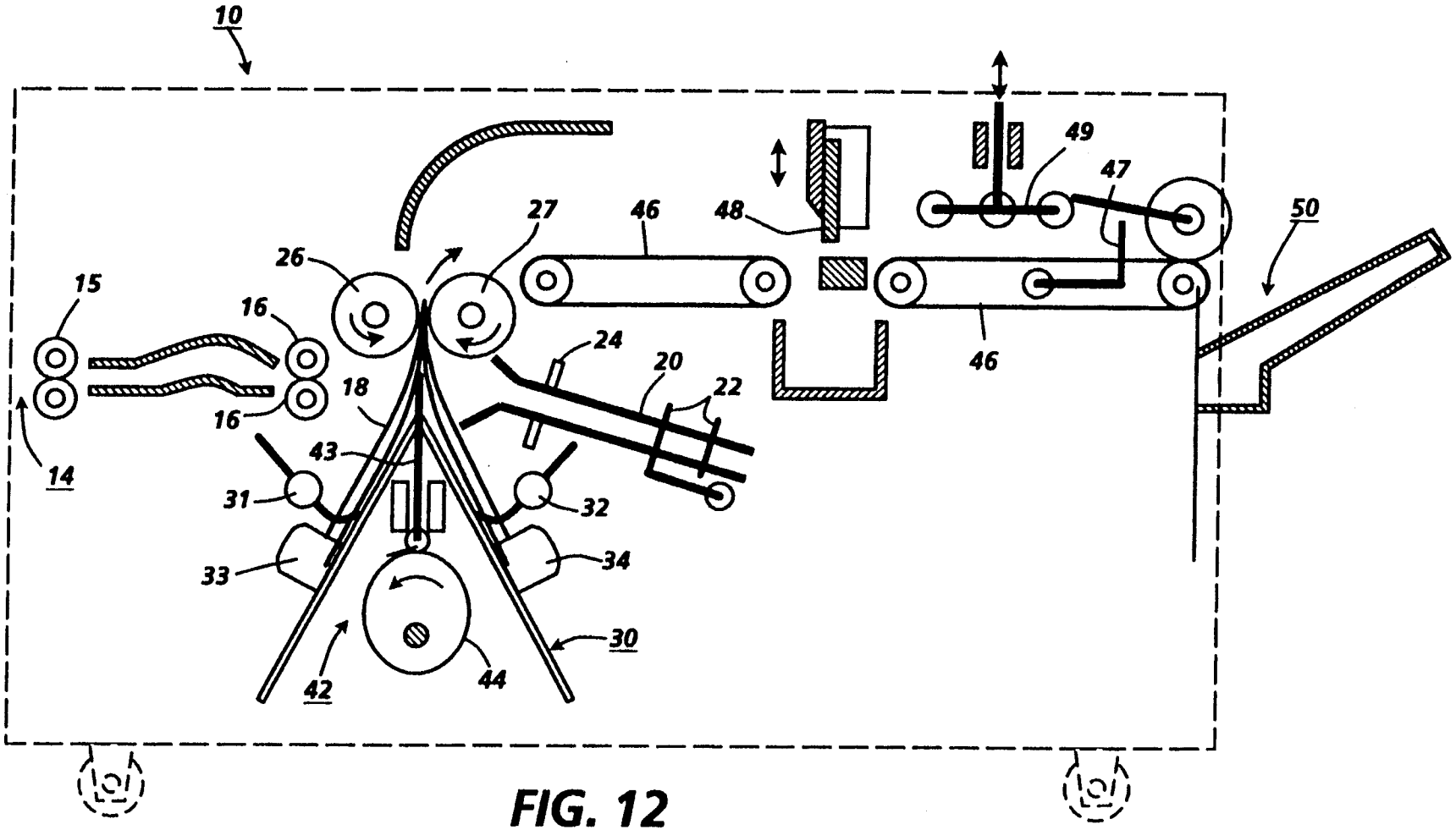

Referring now to FIG. 12, here the set is repositioned in its central or compiling position on the compiler 30 after stapling, so that a set ejection mechanism 42, here comprising a spline knife edge or blades member(s) 43 driven by an eccentric cam 44, may push the set up (from the inside of its spline) into fold rolls 26, 27, which are now rotating in the direction shown here. Spring mounting of these rollers, such as noted herein elsewhere and shown in FIG. 15, allows the nip to open enough to accommodate the full set thickness and positively feed the entire set out through the same nip previously used to individually fold the sheets of that set.

Figure 13:
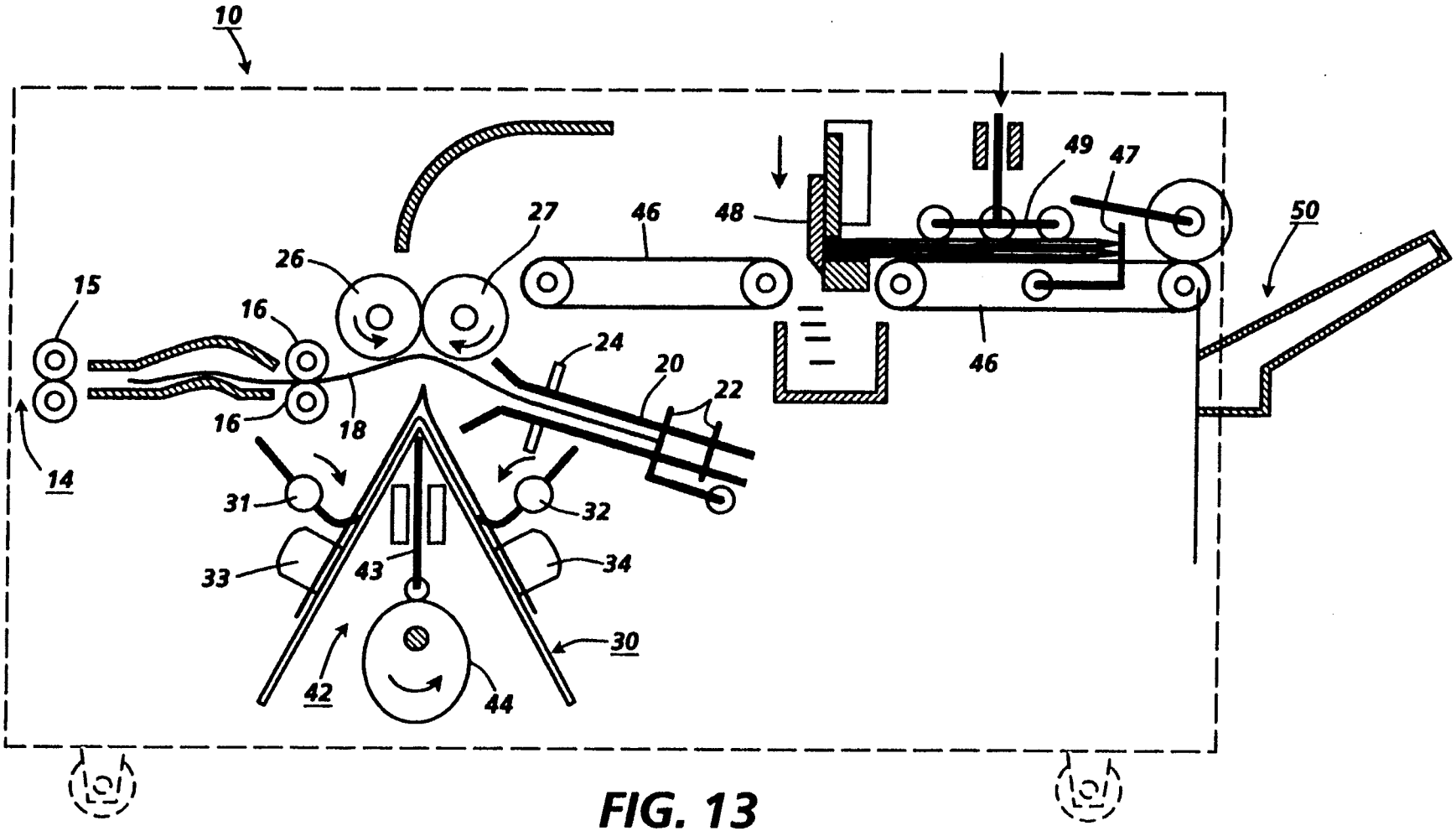

Thus, as shown in FIG. 13, the entire set is now ejected by the fold rolls 26, 27 out onto a set exit transport 46, where it is transported until it is stopped by a set trim gate 47 engaging the downstream or spline end of the stapled booklet. An adjustable position edge trimmer or knife 48 then comes down to trim off the downstream or loose end of the booklet in a conventional manner to provide a commercially desirable completely square or cut end booklet, irrespective of the number of folded sheets in the set. This may be assisted as shown by a set holddown or clamp 49. The trimmed set is now ejected by now opening the set gate 47 and operating the exit transport 46 to further feed the set out from the unit 10 onto a set stacker elevator 50. As shown here, this may be integral of the end of the unit 1(::). It may move down automatically to accommodate the stacking of a substantial number of finished sets in a known conventional manner. The sets are desirably stacked with the spline or folded and stapled end outwardly, for ease of operator removal, without requiring any inversion of the sets.

Figure 16:
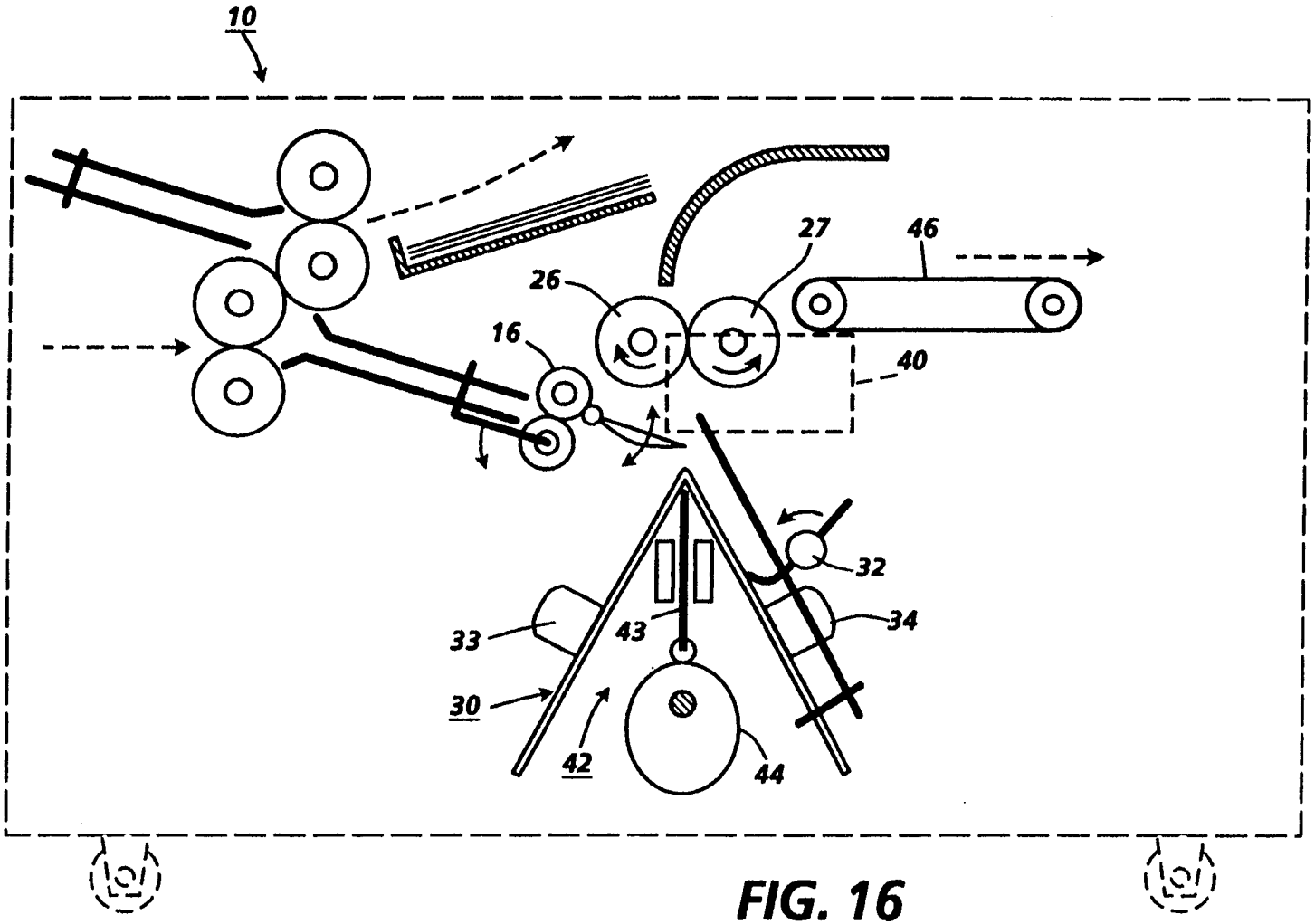
FIG. 16 illustrates an alternative embodiment of a folding architecture.

Referring now to FIG. 16, there is illustrated an alternative embodiment of the folding architecture. This is another example of several possible variations on the architecture shown in the previous figures. For example, by providing additional upstream fold rolls, or moving the fold roll nips further above the saddle compiling station, and providing an upstream fold plate stop therefor, a conventional folding device can be used to perform the prefolding function. This yields a less compact booklet making architecture, but enables the device to also function as a conventional folder for optional letter or "Z" folding, etc. Such a standard buckle folder may have an optional direct exit for folded single sheets upstream of the compiler/stapler unit, as shown in FIG. 16.

As also shown in FIG. 16 another or additional option is for the previously illustrated fold plate 20 system to be located parallel to the right side of the compiler 30. An additional deflector gate can be provided above the left (upstream) side of the compiler, as shown, to deflect down the trailing half of the prefolded sheet down onto the left or trail edge side of the compiler.

In any case, the sheets may be sequentially individually fully centerfolded and then directly placed on the directly adjacent saddle compiler for compiling and stapling, and with positive control over the open ends of the prefolded sheets, so that they do not close before the folded sheet is placed on the compiler.

While the embodiment disclosed herein is preferred, it will be appreciated from this teaching that various alternatives, modifications, variations or improvements therein may be made by those skilled in the art, which are intended to be encompassed by the following claims:

We claim:

1. In a signatures finishing system for on-line center folding of sets of signature sheets outputted by a reproduction system using a saddle compiler with two opposite sides forming an inverted "V"; the improvement comprising:

a pair of reversible folding rollers closely adjacent to said saddle compilor and forming a folding rollers nip;

an input sheet feeding system for feeding the central area of each outputted signature sheet into said folding rollers nip for sequentially individually fully folding said signature sheets in said folding rollers nip as they are outputted by said reproduction system;

a reversible drive for said folding rollers which is automatically reversed at a position which will sequentially stack each so folded signature sheet on said adjacent saddle compiler to form plural sheet compiled pre-folded signature sheet booklets, and a set ejector for ejecting said compiled folded signatures booklet from said saddle compiler fully through said same folding rollers nip to a booklet output system, while said reversible drive for said folding rollers is re-reversed.

2. The signatures finishing system of claim 1 wherein said sheets are so reversed after being center folded in said folding rollers nip by said reversible drive at a position in which the opposite ends of the sheet engage said opposite side of the saddle compiler to provide positive control of the folded sheet ends and to prevent closure of the folded sheet ends before said compiling.

3. The signatures finishing system of claim 1 wherein said folding rollers nip is substantially expandable for feeding said compiled booklets therethrough versus said folding of individual signature sheets therein.

4. The signatures finishing system of claim 1 further including a stapling system for stapling said compiled booklet while it is on said saddle compiler.

5. The signatures finishing system of claim 1 wherein said booklet output system includes a booklet edge trimmer and booklet stacker for edge trimming and stacking the booklets ejected through said folding rollers nip.

6. The signatures finishing system of claim 1 wherein the central area of each signature sheet is buckled into said finishing rollers nip by said input sheet feeding system, and said folding rollers nip feeds an individual signature sheet partially centrally therethrough to center fold it, and then said nip reverses substantially before the ends of the signature sheet are in said nip to respectively feed the ends of the signature sheet out to said opposite sides of said saddle compiler.

7. In a signatures finishing system for on-line center folding of sets of signature sheets outputted by a reproduction system; the improvement comprising the steps of:

sequentially individually fully folding said signature sheets in a folding rollers nip as they are outputted by said reproduction system, and then reversing said folding rollers nip with a signature sheet therein and sequentially stacking said so folded signature sheets on a closely adjacent saddle compiler repeating said steps to form plural sheet compiled pre-folded signature sheet booklets in said saddle compiler, and then ejecting said compiled folded signatures booklet from said saddle compiler fully through said same folding rollers nip to a booklet output system by re-reversing and further opening said folding rollers nip.

8. The signatures finishing system of claim 1 wherein said sheets are reversed after being center folded in said folding rollers nip at a position in which the opposite ends of the sheet engage the opposite sides of the saddle compiler to provide positive control of the folded sheet ends and to prevent closure of the folded sheet ends before compiling.

9. The signatures finishing system of claim 1 wherein said folding rollers nip opens substantially further for feeding said compiled booklets therethrough versus said folding of individual signature sheets therein.

10. The signatures finishing system of claim 1 further including the step of center stapling said compiled booklet while it is on said saddle compiler.

11. The signatures finishing system of claim 1 wherein said booklet output system includes edge trimming and stacking the booklets ejected through said folding rollers nip.

12. The signatures finishing system of claim 1 wherein the central area of each signature sheet is buckled into said folding rollers nip, which nip feeds the individual signature sheet partially centrally therethrough to center fold it, and then said folding rollers nip reverses before the ends of the signature sheet are in said nip to respectively feed the ends of the signature sheet out to opposite sides of said saddle compiler.

* * * * *